US005360515A

United States Patent [19]

Francis et al.

[11] Patent Number: 5,360,515

[45] Date of Patent: Nov. 1, 1994

[54] METHOD FOR REDUCING THERMAL AND LIGHT-INDUCED BRIGHTNESS REVERSION IN LIGNIN-CONTAINING PULPS

[75] Inventors: Raymond C. Francis, Dewitt, N.Y.; Daniel B. Evans, Bethlehem, Pa.

[73] Assignees: The Research Foundation of the State University of New York, Albany, N.Y.; Minerals Technology Inc., New York, N.Y.

[21] Appl. No.: 111,627

[22] Filed: Aug. 25, 1993

[51] Int. Cl.[5] ..... D21H 17/05

[52] U.S. Cl. ..... 162/135; 162/158; 162/160; 162/181.2; 106/287.23; 106/465; 106/506; 427/395

[58] Field of Search ..... 162/160, 158, 72, 135, 162/181.2; 427/394, 395; 8/101, 107, 116.1; 106/287.23, 506, 465

[56] References Cited

U.S. PATENT DOCUMENTS

| | | | |
|---|---|---|---|
| 4,871,423 | 10/1989 | Grimsley et al. | 162/72 |
| 5,043,017 | 8/1991 | Passaretti | 106/465 |
| 5,080,754 | 1/1992 | Francis et al. | 162/9 |
| 5,156,719 | 10/1992 | Passaretti | 162/158 |

FOREIGN PATENT DOCUMENTS

| | | | |
|---|---|---|---|
| 280332 | 8/1988 | European Pat. Off. | D21C 9/00 |
| WO92/09745 | 6/1992 | WIPO | D21H 17/74 |

OTHER PUBLICATIONS

Tschirner and Dence, "Attemps to photostabilize Norway spruce TMP by chemical modification" *Paper and Timber* 4, 338–346 (1988).

Janson and Forsskåhl, "Color changes in lignin-rich pulps on irradiation by light" *Nordic Pulp & Paper Research Journal* 4, 197–205 (1989).

Gellerstedt et al., "Light-induced and heat-induced yellowing of mechanical pulps" *Svensk Papperstidning*, R157–163 (1983).

Rättö et al. "Photostabilization of Mechanical pulps by polyvinylpyrrolidone" *Tappi Journal* 76, 67–70 (1993).

*Primary Examiner*—Peter Chin

*Attorney, Agent, or Firm*—Heslin & Rothenberg

[57] ABSTRACT

A method and article of manufacture thereof is provided for reducing brightness reversion in bleached lignin-containing pulps or newsprint by the treatment of the bleached lignin-containing pulp or newsprint with 2,5-dihydroxydioxane. In one embodiment, calcium carbonate is added to enhance the activity of 2,5-dihydroxydioxane.

28 Claims, 2 Drawing Sheets

METHOD FOR REDUCING THERMAL AND LIGHT-INDUCED BRIGHTNESS REVERSION IN LIGNIN-CONTAINING PULPS

BACKGROUND OF THE INVENTION

1. Field of the Invention

This invention relates to the field of paper manufacturing and, more particularly, to maintaining the brightness of bleached pulps or paper containing lignin. Maintaining brightness is also known in the industry as retarding or reducing brightness reversion.

2. Description of the Prior Art

Pulp is the raw material for the production of paper, paperboard, fiberboard and the like. It is obtained from plant fiber such as wood, straw, bamboo and sugarcane residues. Wood is the source of 95% of the pulp fiber produced in the United States. Dry wood consists of 40 to 50 percent cellulose, 15 to 25 percent other polysaccharides known as hemicelluloses, 20–30 percent lignin, a biopolymer which acts as a matrix for the cellulose fibers, and 5 percent of other substances such as mineral salts, sugars, fatty acids, resins and proteins. Lignin is composed primarily of methoxylated phenylpropane monomeric units interconnected by a variety of stable carbon-carbon and carbon-oxygen (ether) linkages. The color of paper produced from pulp arises from the lignin.

Paper or pulps containing lignin or lignocellulose are commonly dark and must be bleached if a white paper is desired. A major drawback of bleached lignin-containing pulps is that they are easily and extensively darkened by light irradiation. This limits their use in various grades of printing papers.

Paper or pulp used in making newsprint is generally not bleached. If it is bleached, it is relatively mildly bleached as compared to higher quality paper. Therefore, such unbleached or mildly bleached pulps have a darker quality than bleached pulps. Newsprint has a relatively high lignin content and, therefore, has a tendency to become even darker when exposed to light. The present invention can be used to prevent darkening of all types of lignin-containing pulps including bleached and unbleached pulps, such as newsprint.

The whiteness of paper is estimated by brightness measurements which are based on the reflectance of light having an average wavelength of 457 nm. An Elrepho brightness meter is one type of instrument used to measure paper brightness. A low brightness (40% Elrepho) indicates brown or dark paper, while 90% Elrepho typifies white paper. Lignin-rich pulps have brightness values in the range of 50–70% Elrepho, depending on the wood species used and the pulping process. These pulps can be bleached to 70–90% brightness using known brighteners such as hydrogen peroxide, sodium borohydride or sodium dithionite. Hydrogen peroxide is normally used when a brightness of more than 70% is required. A problem with bleached lignin-rich pulps is that they may darken by as much as 20 Elrepho points when exposed to natural sunlight during exposure over a period of only one day.

Several methods are presently known to decrease brightness reversion in pulps containing high levels of lignin. The disadvantage of these methods is that they add significantly to the cost of the paper manufacturing process and are less effective than the method of the invention.

One known method described in European Patent No. 0 280 332 (Agnemo et al.) consists of serial treatments to reduce the carbonyl groups (photosensitizers) contained in the pulp to alcohol groups. In addition, the process includes alkylation of the phenolic hydroxyl groups in the lignin, from which hydrogen atoms are abstracted, by the use of an alkaline propylene oxide. Addition of fluorescent compounds that absorb or reflect the ultraviolet light which would otherwise excite photosensitizer groups is also disclosed.

It has recently been discovered that compounds with a labile hydrogen atom can significantly decrease the rate of darkening of high-yield pulps when they are irradiated with ultraviolet light. Effective anti-reversion agents include ascorbic acid, sulfoxylates, thiols and 2,4-hexadien-1-ol. Our own earlier U.S. Pat. No. 5,080,754 describes the use of formyl compounds as additives which donate hydrogen atoms to reactive intermediates created in the bleached pulp upon exposure to light.

All known additives suffer from the drawback that while they inhibit light-induced reversion, they accelerate the yellowing that occurs on routine storage out of the light (thermal reversion). Thermal reversion is another phenomenon that limits the use of high-yield pulps in certain grades of paper.

While not wishing to be restricted to a particular theory, it may be hypothesized that during UV irradiation, hydrogen donors trap the highly reactive hydroxyl radical and possibly the photoexited species as shown below:

$$\cdot OH + RH \longrightarrow R\cdot + H_2O \qquad [1]$$

$$\begin{matrix} \diagdown \\ \diagdown \end{matrix}C{=}O^* \xrightarrow{RH} R\cdot + \cdot\overset{|}{\underset{|}{C}}{-}OH \xrightarrow{RH} R\cdot + H\overset{|}{\underset{|}{C}}OH \qquad [2]$$

At the same time, but with the opposite effect, the known anti-reversion agents may react with $0_2$ and transition metals to generate other free radicals as shown below:

The rate of light reversion with natural sunlight is 100–1,000 times greater than reversion in the dark (ambient or thermal reversion). Therefore, the "dark reactions" [3] and [4] can be ignored during light aging. However, in the absence of UV light, the participation of hydrogen donors in the "dark reactions" may accelerate ambient or thermal reversion by increasing the concentration of free radicals.

Although retardation of light reversion is usually more critical than retardation of thermal reversion, an acceleration in thermal reversion is likewise undesirable. A need thus persists for an efficient and low cost paper manufacturing process which reduces both light-induced and thermal brightness reversion of bleached pulps containing lignin.

SUMMARY OF THE INVENTION

This need is satisfied and the shortcomings of the prior art are overcome, in accordance with the principles of the present invention.

The present invention discloses that 2,5-dihydroxydioxane (DHD), also known as glycolaldehyde dimer, can be added to the papermaking process to retard brightness reversion.

In one aspect the invention relates to a process for inhibiting brightness reversion in a lignin-containing substrate comprising treating the substrate with 2,5-dihydroxydioxane. The lignin-containing substrate may additionally contain from 2% to 35% calcium carbonate. A preferred form of calcium carbonate is so-called "acid-stabilized, precipitated calcium carbonate."

In an embodiment, when the lignin-containing substrate is paper, the treatment may be accomplished by dipping the paper in a solution of 2,5-dihydroxydioxane or by spraying the paper with a solution of 2,5-dihydroxydioxane.

In an embodiment wherein the lignin-containing substrate is a pulp, the process may be accomplished by adding 2,5-dihydroxydioxane to the pulp prior to sheet formation.

In another aspect, the invention relates to a method for reducing brightness reversion of bleached pulps containing lignin, comprising the steps of forming the pulps into a sheet and treating the sheet with 2,5-dihydroxydioxane. The pulp may be further treated with calcium carbonate. The same method can be applied to reduce brightness reversion of unbleached or lightly bleached pulps containing lignin that are intended for use as newsprint.

In another aspect, the invention relates to a lignocellulosic article resistant to brightness reversion comprising a lignocellulosic substrate and an amount of 2,5-dihydroxydioxane sufficient to inhibit light reversion. The lignocellulosic article may additionally comprise from 2% to 35% by weight of calcium carbonate. The amount of 2,5-dihydroxydioxane may be from 0.1% to 30%, and the article may be a paper, in which case the amount of 2,5-dihydroxydioxane is preferably from 0.2% to 10%, most preferably about 5% by weight; the calcium carbonate is preferably from about 5% to about 25% by weight. The article may also be a pulp, in particular, a thermomechanical pulp or a bleached chemithermomechanical pulp.

In another, similar aspect, the invention relates to a sheet of paper comprising bleached pulps containing lignin, which pulps have been treated with 2,5-dihydroxydioxane. They may have been additionally treated with calcium carbonate. The sheet of paper may also comprise pulps containing lignin for use as newsprint, which pulps have been treated with 2,5-dihydroxydioxane. These pulps may also have been additionally treated with calcium carbonate.

In a further aspect the invention relates to a composition for inhibiting brightness reversion comprising a mixture of 2,5-dihydroxydioxane and calcium carbonate in water, i.e. a coating formulation containing the two chemicals.

The claimed method for reducing brightness reversion in bleached pulps containing lignin comprises the steps of forming the pulps into a paper sheet and treating the paper sheet with 2,5-dihydroxydioxane. It is believed that 2,5-dihydroxydioxane donates a hydrogen atom to a photoexcited group or free radical more easily than lignin donates a hydrogen atom to the same photo-excited group or free radical. The photo-excited group is created by light irradiation of the paper and may react in such a way as to generate free radicals.

The method of use of 2,5-dihydroxydioxane is enhanced by adding calcium carbonate to the paper. In particular, the addition of calcium carbonate to assist 2,5-dihydroxydioxane has shown good results in reducing brightness reversion.

Accordingly, it is a principal object of this invention to improve the paper manufacturing process and quality of paper produced therefrom as compared to the presently known processes and products.

One significant advantage of this invention is the reduction of light-induced brightness reversion in lignin-containing pulps without concomitant acceleration in thermal brightness reversion.

Another advantage of this invention is the low cost of manufacturing better quality paper. The cost of manufacturing paper according to this invention is only slightly higher than the cost of manufacturing untreated paper. However, the invention provides a dramatic increase in the brightness stabilization of lignin-containing paper.

Yet another advantage of this invention is that it reduces the quantity of wood needed to make good quality paper because it provides the opportunity for expanding the use of mechanical pulps which can be obtained from wood in significantly higher yields than other pulps. Increasing the use of mechanical and other lignin-containing pulps will produce more paper from fewer logs.

A still further advantage of this invention is that the presently known paper manufacturing processes do not need to be significantly altered in order to incorporate the invention. Known methods of production require only a modification in the form of an additional step to treat the paper sheet with the brightness stabilizing compounds.

DETAILED DESCRIPTION

Figure 1:
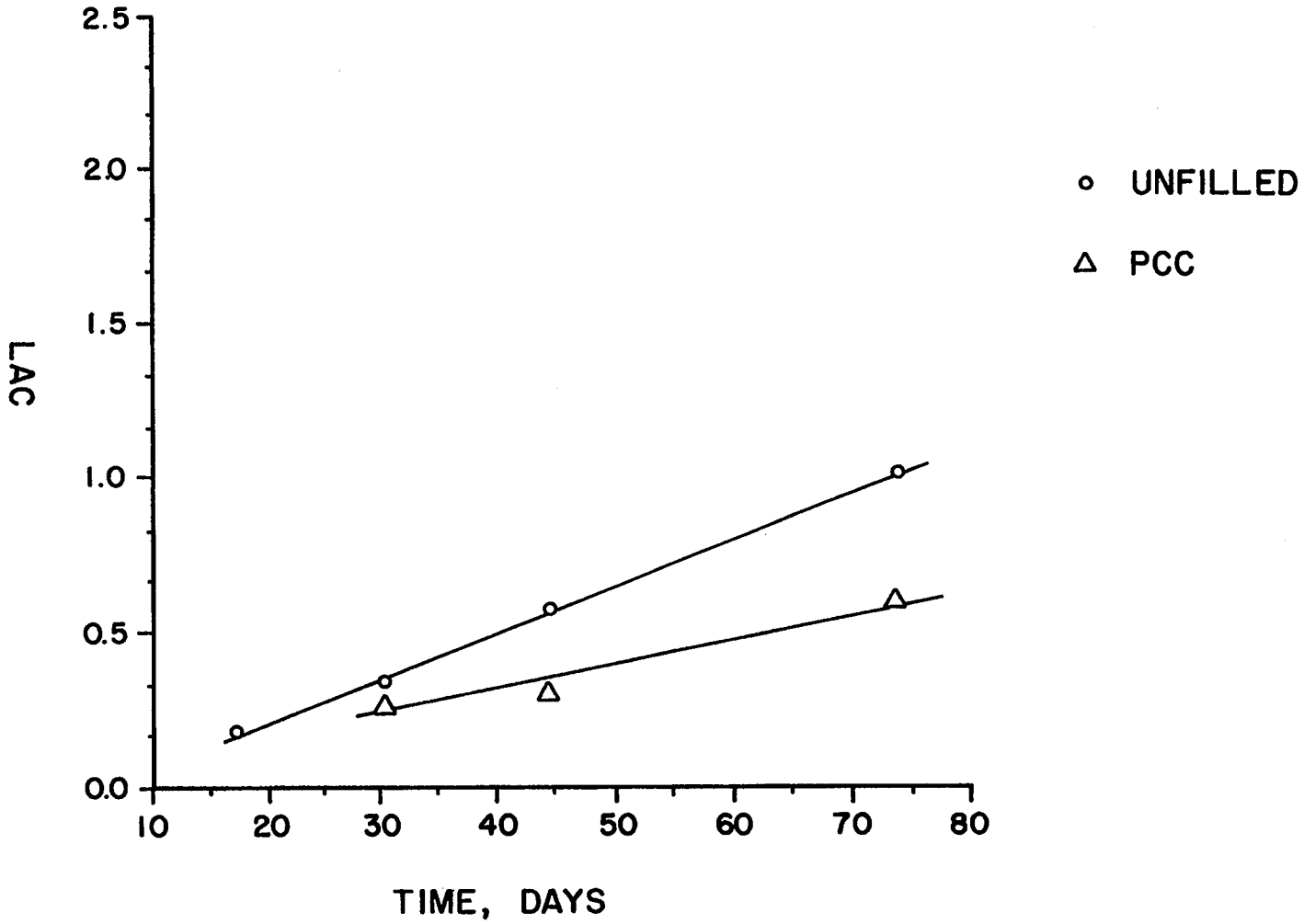
FIGS. 1 and 2 are graphic representations showing the increase in light absorption coefficient (LAC) as a function of time for two pulps, with and without added calcium carbonate.

Pulps or paper are generally divided into two main classes being either "chemical" pulps or "mechanical" pulps. The classification of the pulps is determined by the manner in which the pulps are made from wood. Presently, more chemical pulps are manufactured than mechanical pulps.

In producing chemical pulps, a chemical treatment is used to dissolve the lignin from the wood. In these processes, most of the hemicelluloses are dissolved. Thus, the pulp yield for a chemical pulping process is typically 40%–50% of the wood. Mechanical pulping processes produce more paper per unit of wood, with typical yields being higher than 85%. That is, chemical pulps are characterized by lower yield and lower lignin content. Mechanical pulps are characterized by higher yield of pulp and higher lignin content.

Mechanical pulps require a significant amount of mechanical energy such as grinding to break down wood chips made from the wood. There are different subclasses of mechanical pulps. Groundwood (GW) and pressurized groundwood (PGW) are generally manufactured by pressing wood bolts against a revolving grinder wheel. Refiner mechanical pulps (RMP) are made in disc refiners under ambient pressure and a temperature of approximately 100° C. Thermomechanical pulp (TMP) are made in a process using high pressure steam to elevate the temperature and, thus, soften the lignin making the fibers easier to separate. Chemithermomechanical pulps (CTMP) and thermochemimechanical pulps (TCMP) are made in a process which usually involves lignin sulfonation and high temperature treatments to soften the chips. Chemimechanical pulps (CMP) use a chemical treatment only and do not employ a thermal treatment.

Chemical pulps do contain some lignin, generally less than 5 weight percent as compared to more than 20% for mechanical pulps. The lignin in chemical pulps is completely removed after a multi-stage bleaching process to achieve 90% brightness. However, semi-bleached chemical pulps are not free of lignin. Therefore, certain lignin-containing pulps fall into the chemical class as well.

In addition to the chemical and mechanical pulps, there is an intermediate category of pulps known as "semi-chemical". These pulps are hybrids of mechanical and chemical pulps in that they have higher yields than the chemical pulps (i.e., 50%–85% yield). However, the lignin content is higher than with chemical pulps, and lower than the lignin content of mechanical pulps.

The major drawback to mechanical pulps, semi-chemical pulps, and chemical pulps which are not fully bleached is that they contain lignin which, when irradiated by light, can darken extensively. This limits the use of lignin-containing pulps in various grades of quality printing papers.

During the manufacturing process of paper, the wood chips are broken apart by one of the above methods and the fibers are dispersed in water to form a slurry. The slurry is often bleached or whitened by known processes. The type of bleaching or whitening process used in the manufacturing of bleached lignin-containing pulp may be selected by the manufacturer from any of the standard known processes used to obtain the desired brightness for the pulp. If the lignin-containing pulp is not bleached or mildly bleached, it will usually be used as newsprint and will have a darker quality. If bleached, it will be bleached in a blend chest, bleaching tower or similar vessel. It is then transferred to a papermaking machine. The slurry is spread over a sheet-like or planar surface. Water is removed by filtration, the slurry is pressed into a sheet of the desired thickness and the sheet is then dried. The sheets can be categorized by their thickness (caliper) and are referred to as paper (thin) and/or pulp (thick) sheets.

The invention contemplates treating the pulp with 2,5-dihydroxydioxane just prior to or during the process step where the pulp slurry is engaged in the papermaking machine, and subsequent to any bleaching process, if such bleaching is employed.

The treatment of the paper sheet can take the form of dipping the sheet in a solution of the brightness stabilizing compound(s) coating one or both sides with the compound, or applying or spraying the compound in a solution or solid form onto the sheet surface.

It is believed that the lignin-containing pulp is darkened by sunlight or other irradiating light due to the presence of a photo-excited group within the lignin. This photo-excited group, or free radical generated by it, is believed to abstract a hydrogen atom from the lignin to form a lignin radical. The lignin radical, in turn, reacts with oxygen. The lignin radical plus oxygen forms colored materials. It is believed that these colored materials contribute to the darkening of the paper. See Tschirner & Dence, *Paper and Timber* 4, 338–346 (1988); Janson and Forsskahl, *Nordic Pulp and Research J.*, 3, 197–205 (1989); and Gellerstedt et al., *Svensk Papperstidning* 1983, R157–163.

Therefore, the invention comprises a method of manufacturing paper and article of manufacture thereof with reduced brightness reversion qualities whereby the lignin-containing paper or pulp sheet is treated with 2,5-dihydroxydioxane, which is believed to donate a hydrogen atom to the photo-excited group or free radical more easily than does the lignin complex. 2,5-Dihydroxydioxane (DHD) is a water-soluble solid with a melting point of approximately 85° C. It can be manufactured from the pyrolysis of wood or wastepaper and it is used commercially as a food additive.

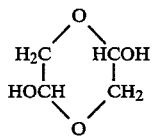

The amount of 2,5-dihydroxydioxane to be used to coat or treat a substrate is dependent upon the desired effect the manufacturer wishes to obtain. A thicker coating generally will have a greater effect than a thin coating of the same uniformity. However, even a very light treatment of 2,5-dihydroxydioxane will have an effect on brightness reversion. (See experiment 4, below) It is up to the manufacturer of the paper to determine what percentage by weight of 2,5-dihydroxydioxane to incorporate in or on the paper sheet. Any percent greater than 0% would have some effect on brightness reversion. The degree of brightness reversion reduction will be determined by the extent of the coating. The practical upper limit is set by the mechanical properties of a paper that has little cellulose and much DHD; in principle, the reversion inhibition will continue to 100% DHD. In practice, the incremental benefit of more than 30% DHD is minimal.

Figure 2:
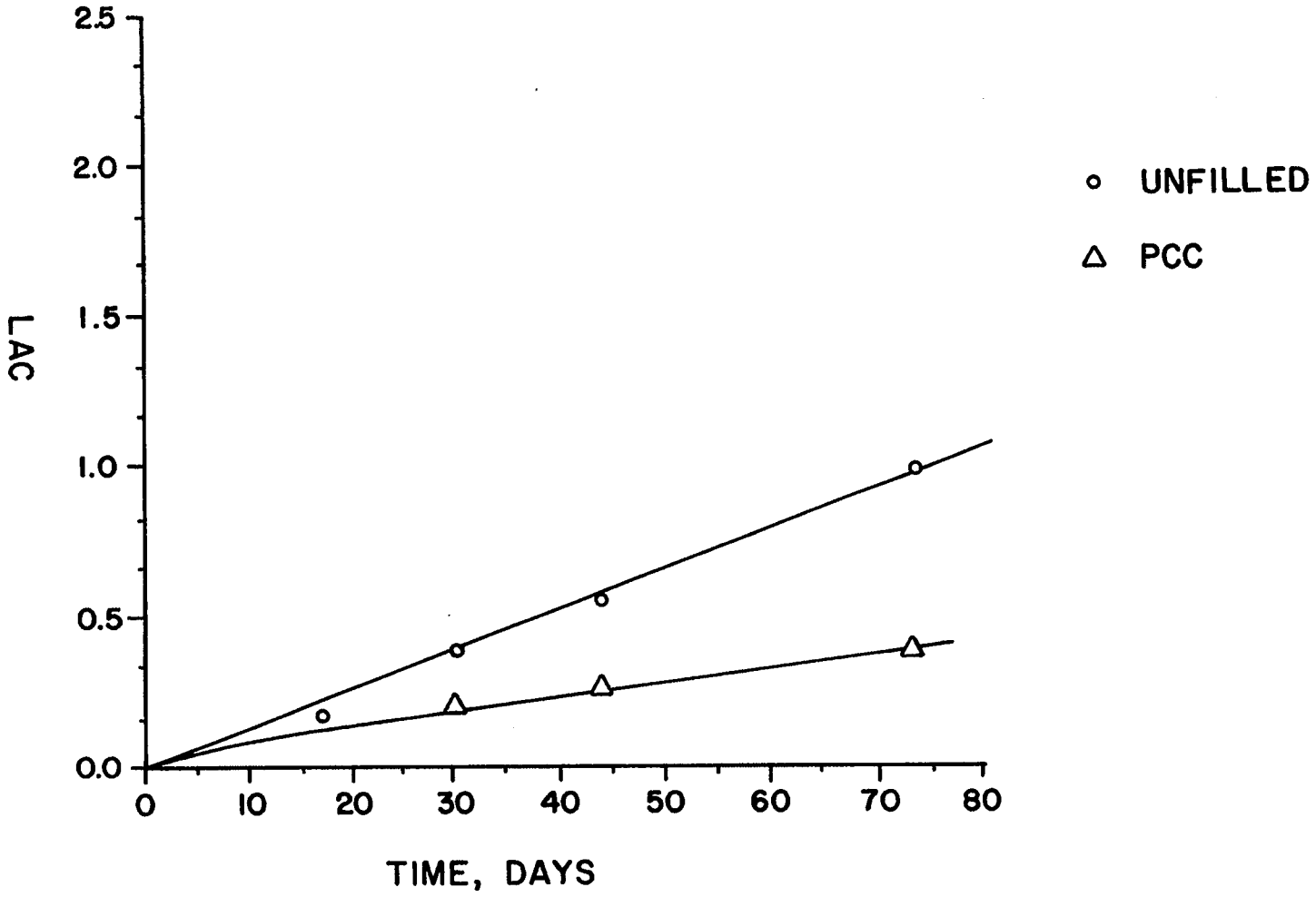

As shown in FIGS. 1 and 2 for laboratory-made bleached thermomechanical pulp (BTMP) and bleached chemithermomechanical pulp (BCTMP), the light absorption coefficient (LAC), which increases linearly with the concentration of chromophores, increased by approximately 1.0 $m^2/kg$ after the pulp had been stored in the dark at 73° F. and 50% relative humidity for 73 days. The brightness loss was 4.1 points for the BTMP and 5.3 points for the BCTMP.

FIGS. 1 and 2 also show that a specially formulated, acid-stabilized, precipitated calcium carbonate (PCC) significantly decreases the rate of thermal reversion. This particular PCC, which is preferred for use in the process of the invention, is described in U.S. Pat. Nos. 5,043,017 and 5,156,719, the disclosures of which are incorporated herein by reference. It contains sodium hexametaphosphate or tripolyphosphate which are known to chelate metals. Chelation of transition metals would decrease the rate of reaction in equation [4] and reduce the rate of thermal reversion. The addition of acid-stabilized PCC increased the initial brightness of the BTMP by 3.6 points and the BCTMP by 2.4 points. The higher initial brightnesses coupled with the lower rates of thermal reversion resulted in brightness advantages (after 73 days) of 5.2 and 6.6 points for the PCC-filled BTMP and BCTMP, respectively. An additional advantage of the acid-stabilized PCC is that it allows the paper to be made at pH 5.5–7.5, thereby reducing "alkaline darkening" of lignin-containing pulps, a further mechanism by which these pulps can undergo brightness loss.

In a commercial setting, the invention contemplates treating the pulp with a brightness-maintaining compound or compounds just prior to or during the process step where the pulp slurry is engaged in the papermaking machine and subsequent to any bleaching process, if such bleaching is employed. The treatment of the paper sheet can take the form of dipping the sheet in a solution of the brightness stabilizing compound(s), coating one or both sides with the compound(s), applying or spraying the compound(s) in a solution or solid form onto the sheet surface or adding the compound(s) along with sizing formulations.

Without further elaboration, it is believed one skilled in the art can utilize the present invention to its fullest extent. The following embodiments are, therefore, to be construed as merely illustrative and not limitative of the remainder of the disclosure whatsoever.

The following examples are given to illustrate the activity of 2,5-dihydroxydioxane. In all of the examples set forth below, the light-aging process was accelerated by placing pulp sheets (relatively thick), or paper sheets (relatively thin) close to a high intensity light source. The sheets were placed in water-cooled compartments approximately 11.5 cm from a 1,000 watt mercury-tungsten lamp which emitted light at wavelengths above 300 nm.

EXAMPLE 1

A peroxide-bleached TMP pulp sheet of 73.7% Elrepho brightness was used. 2,5-Dihydroxydioxane was dissolved in water at a concentration of 0.0125 g/mL. The pH of the solution was approximately 6.0. Laboratory-made BTMP sheets were saturated with 4 mL/g of the solution. Upon air-drying (ambient conditions), the charge of the chemical was 5.0% of the initial weight of the paper. It can be seen in Table 1 that the initial brightness of the sheet increased; after 3 h of light aging the treated sheet was 5 points brighter than the control. After 18 and 60 days in the dark (73° F. and 50% R.H.) the treated sheet was virtually indistinguishable from the control, indicating that no acceleration of thermal reversion had occurred.

TABLE 1

| | Untreated | 5% DHD |
|---|---|---|
| Initial Brightness, % Elrepho | 73.7 (1.71)* | 74.1 (1.61) |
| After 1 h Light Aging | 61.4 (4.26) | 64.6 (3.36) |
| After 3 h Light Aging | 55.1 (6.42) | 60.1 (4.58) |
| After 18 Days Thermal Aging | 72.5 | 72.6 |
| After 60 Days Thermal Aging | 70.4 | 70.4 |

*LAC

EXAMPLE 2

A pulp blend that consisted of 70% bleached pressurized groundwood (PGW) and 30% bleached kraft was the starting material. The pulp blend was converted to paper filled with acid-stabilized PCC 27.3% of paper weight) on a commercial paper-machine. In the laboratory, the paper was treated with a solution of 2,5-dihydroxydioxane as described in Example 1. The results in Table 2 show the same trends as in Table 1. It can also be seen that the control sheet only lost 3.7 points of brightness after 1 h of light aging. This indicates that PCC on its own retards light reversion to a certain extent, as previously reported (U.S. Pat. No. 5,080,754). However, photostabilization by PCC is only observed when it constitutes a high weight fraction (>10%) of the paper.

TABLE 2

| | PCC | PCC + DHD |
|---|---|---|
| Initial Brightness | 70.4 | 71.2 |
| After 1 h of Light | 66.7 | 68.4 |
| After 4 h of Light | 64.9 | 67.6 |
| After 60 Days Thermal | 70.2 | 70.6 |

EXAMPLE 3

A similar pulp blend from a different mill was converted to paper with the inclusion of 22.4 weight % acid-stabilized PCC. In the laboratory, the paper was treated with 2,5-dihydroxydioxane as described in Example 1. The results in Table 3 show all the same trends as those in Tables 1 and 2.

TABLE 3

| | Untreated + $CaCO_3$ | $CaCO_3$ + DHD-Treated |
|---|---|---|
| Initial Brightness | 71.6 | 72.3 |
| After 1 h of Light | 66.9 | 68.9 |
| After 4 h of Light | 64.6 | 67.4 |
| After 60 Days Thermal | 71.3 | 72.3 |

EXAMPLE 4

The experiment of Example 1 was repeated, but with only 0.2% DHD on the BCTMP sheets. Sixty-four days had expired between the two experiments and the untreated sheets had lost more than two points of brightness. The sheets were kept in an office with uncontrolled temperature and humidity. Thermal reversion experiments are normally conducted in a laboratory with carefully controlled temperature and humidity. The results in Table 4 show that even at the 0.2% addition level, the DHD had a slight positive effect on optical properties.

TABLE 4

| | Untreated | 0.2% DHD |
|---|---|---|
| Initial Brightness, % Elrepho | 71.3 (2.08)* | 71.5 (2.02) |
| After 1 h Light Aging | 59.9 (4.48) | 60.3 (4.35) |
| After 2 h Light Aging | 56.6 (5.54) | 56.9 (5.43) |

*LAC

From the foregoing description, one skilled in the art can easily ascertain the essential characteristics of this invention and, without departing from the spirit and scope thereof, can make various changes and modifications to the invention in order to adapt it to various usages and conditions.

What is claimed is:

1. A process for inhibiting brightness reversion in a lignin-containing substrate comprising treating said substrate with 2,5-dihydroxydioxane.

2. A process according to claim 1 wherein said lignin-containing substrate additionally contains from 2% to 35% calcium carbonate.

3. A process according to claim 2 wherein said calcium carbonate is acid-stabilized, precipitated calcium carbonate and said substrate is paper manufactured in the pH range 5.5 to 7.5.

4. A process according to claim 1 wherein said lignin-containing substrate is paper.

5. A process according to claim 4 wherein treating said substrate is accomplished by dipping said substrate in a solution of 2,5-dihydroxydioxane.

6. A process according to claim 4 wherein treating said substrate is accomplished by spraying said substrate with a solution of 2,5-dihydroxydioxane.

7. A process according to claim 1 wherein said lignin-containing substrate is a pulp.

8. A process according to claim 7 wherein treating said substrate is accomplished by adding 2,5-dihydroxydioxane to said pulp prior to sheet formation.

9. A method for reducing brightness reversion of bleached pulps containing lignin, comprising the steps of forming said pulps into a sheet and treating said sheet with 2,5-dihydroxydioxane.

10. A method for reducing brightness reversion according to claim 9 wherein said pulp is also treated with calcium carbonate.

11. A method for reducing brightness reversion of pulps containing lignin for use as newsprint comprising the steps of forming said pulps into a sheet of newsprint paper, and treating said newsprint sheet with 2,5-dihydroxydioxane.

12. A method for reducing brightness reversion according to claim 10 wherein said sheet is further treated with calcium carbonate.

13. A method according to claim 12 wherein said calcium carbonate is acid-stabilized, precipitated calcium carbonate.

14. A lignocellulosic article resistant to brightness reversion comprising a lignocellulosic substrate and an amount of 2,5-dihydroxydioxane sufficient to inhibit light reversion.

15. A lignocellulosic article according to claim 14 additionally comprising from 5% to 30% by weight of calcium carbonate.

16. A lignocellulosic article according to claim 14 wherein said amount of 2,5-dihydroxydioxane is from 0.1% to 30%.

17. A paper according to claim 14.

18. A paper according to claim 17 wherein said amount of 2,5-dihydroxydioxane is from 0.2% to 10%.

19. A paper according to claim 18 comprising about 5% by weight 2,5-dihydroxydioxane and from about 5 to about 30% by weight calcium carbonate.

20. A pulp according to claim 14.

21. A bleached thermomechanical pulp according to claim 20.

22. A bleached chemithermomechanical pulp according to claim 20.

23. A sheet of paper comprising bleached pulps containing lignin, which pulps have been treated with 2,5-dihydroxydioxane.

24. A sheet of paper comprising bleached pulps according to claim 23 which pulps have been additionally treated with calcium carbonate.

25. A sheet of paper comprising bleached pulps according to claim 24 wherein said calcium carbonate is acid-stabilized, precipitated calcium carbonate.

26. A sheet of paper comprising pulps containing lignin for use as newsprint, which pulps have been treated with 2,5-dihydroxydioxane.

27. A sheet of paper comprising pulps according to claim 26 which pulps have been additionally treated with calcium carbonate.

28. A sheet of paper according to claim 27 wherein said calcium carbonate is acid-stabilized, precipitated calcium carbonate.

* * * * *